US009883701B2

(12) United States Patent
Lima

(10) Patent No.: US 9,883,701 B2
(45) Date of Patent: Feb. 6, 2018

(54) AIR BRA

(71) Applicant: Clemente F. Lima, Franksville, WI (US)

(72) Inventor: Clemente F. Lima, Franksville, WI (US)

( * ) Notice: Subject to any disclaimer, the term of this patent is extended or adjusted under 35 U.S.C. 154(b) by 0 days.

(21) Appl. No.: 15/045,815

(22) Filed: Feb. 17, 2016

(65) Prior Publication Data

US 2017/0231291 A1 Aug. 17, 2017

(51) Int. Cl.
*A41C 3/00* (2006.01)
*A41C 3/10* (2006.01)

(52) U.S. Cl.
CPC ..... *A41C 3/105* (2013.01); *A41C 3/0028* (2013.01)

(58) Field of Classification Search
CPC ..... A41C 3/0065; A41C 3/0007; A41C 3/105
USPC ..... 450/38, 54–57; 2/267, 268, 67
See application file for complete search history.

(56) References Cited

U.S. PATENT DOCUMENTS 3,326,218 A * 6/1967 McAlpine ..... A41C 3/105 450/38
4,992,074 A * 2/1991 Diaz ..... A41C 3/065 2/267
5,347,656 A * 9/1994 Fabritz ..... A41C 3/105 2/67
5,823,852 A * 10/1998 Chu ..... A41C 3/105 137/844
5,833,515 A * 11/1998 Shahbazian ..... A41C 3/105 2/267
6,080,037 A * 6/2000 Lee ..... A41C 3/105 2/67
6,302,760 B1 * 10/2001 Dai ..... A41C 3/105 450/38
6,461,221 B1 * 10/2002 Stilwell ..... A41C 3/0007 450/38
2010/0068973 A1 * 3/2010 Tseng ..... A41C 3/105 450/55
2011/0065358 A1 * 3/2011 Fleeton ..... A41C 3/105 450/38
2013/0012100 A1 * 1/2013 Chen ..... A41C 3/105 450/38

* cited by examiner

*Primary Examiner* — Gloria Hale
(74) *Attorney, Agent, or Firm* — Jansson Munger McKinley & Kirby Ltd.

(57) ABSTRACT

A brassiere for breast enhancement and breast safety in women is disclosed. The brassiere has two cups which are at least partially comprised of stretchable material and house an air-tight chamber inserted into either one or both of the cups, a pump or tube for inflating and deflating air in the chambers using an air valve and a press button. The brassiere of the present invention uses the air chamber(s) to protect the chest area of a woman from impact and is used for enlarging and beautifying the breasts of women.

6 Claims, 1 Drawing Sheet

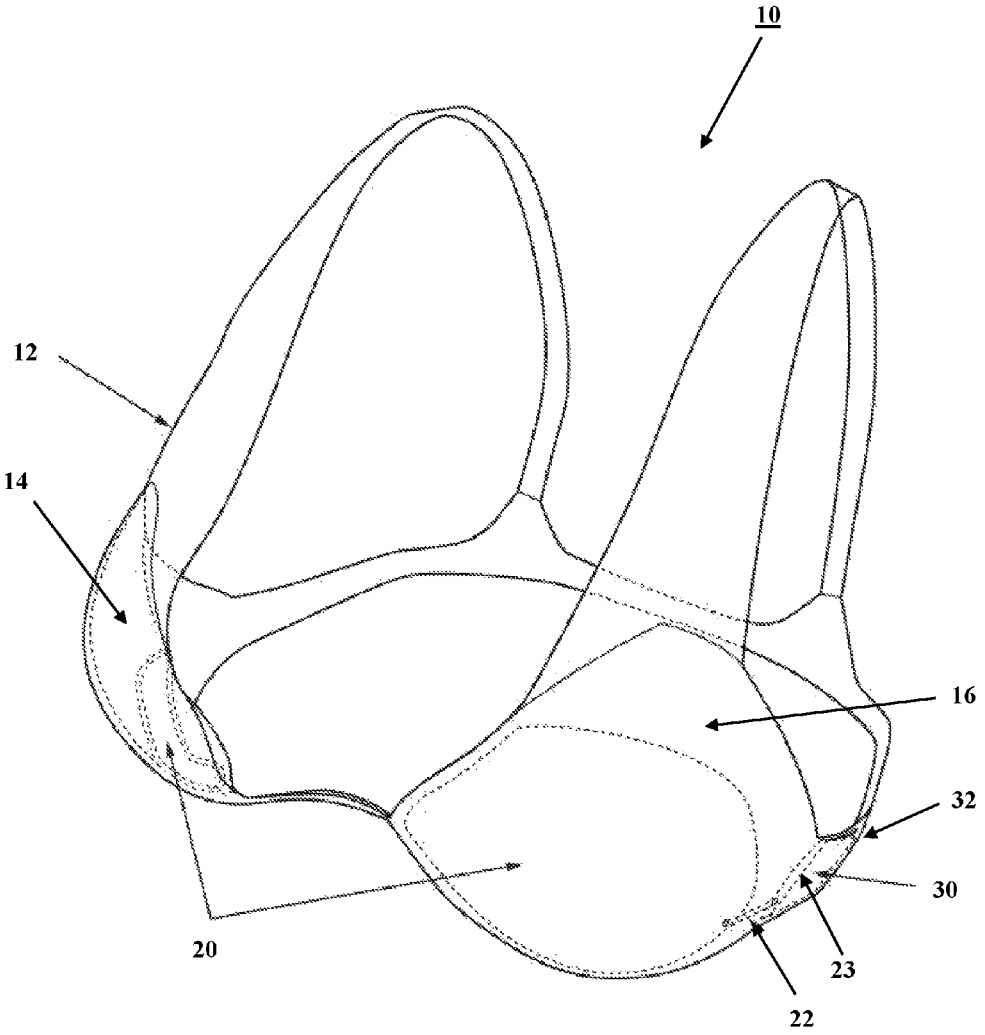
10
12
14
16
32
30
23
22
20

AIR BRA

FIELD OF THE INVENTION

The present invention relates to adjustable brassieres, more particularly, to a brassiere having an air intake pump operated by pressing to draw air in the chamber or air pockets embedded in the brassiere so that the user can exactly adjust the air pockets to the required size.

BACKGROUND OF THE INVENTION

It is well known that a brassiere is worn to protect and to prevent breasts from drooping but since it primarily comprises an elastic band, the conventional brassiere strongly presses against the chest of a wearer. So, if a wearer wears the conventional brassiere for a long time, she feels uncomfortable because of the pressure of the elastic band and also because the ventilation of the brassiere is not good. Accordingly, the above such effects badly affect the wearer's skin. The conventional brassiere provides the above stated functions only to breasts of the female. However, females who wear brassieres in practice require other functions such as to complement the shape of small breasts or drooped breasts and the like.

There have been many prior art patents that solve the above described problem relating to adjustable brassiers as follows: U.S. Pat. No. 6,015,332A issued to Lee discloses a push-up bra having an envelope between the front panel and the rear panel of the bra cups, that receives a flexible pouch containing a mixture of water and a hygroscopic agent such as 70% glycerine—30% water. The hygroscopic agent will draw moisture into the envelope preventing the volume of liquid from decreasing. U.S. Pat. No. 8,047,891 issued to Nikita discloses a brassiere having air bags or the like which can provide apparent enhancement without the need for surgery, or for use after surgical loss of breast tissue. The brassiere can also be used by women who desire breast enlargement. U.S. Pat. No. 6,080,037 issued to Lee discloses an improved brassiere which complements the shape of small breasts and drooped breasts and at the same time makes the wearer feel good by providing ventilation and enhancing hygiene of the brassiere. U.S. Pat. No. 6,302,760 issued to Dai discloses an air intake pump operated by pressing to draw external air bags imbedded therein so that the user can exactly adjust their bags which may be deflated for adjustment or storage by pressing the air bags.

Therefore, the prior art teaches that apparatuses and methods of inflation of air bag type brassieres are inconvenient and time consuming. Moreover, it is very inelegant to adjust the brassiere in public places extemporaneously. Private and fast adjustment cannot be achieved. Therefore a need exists for a simple and inexpensive method of providing brassiere having an extra safety feature from force (like from being inadvertently hit by a ball during sports), by incorporating an extra chamber for pumping air inside the brassiere.

SUMMARY

A brassiere for breast enhancement and breast safety in women is disclosed. The brassiere has two cups which are at least partially comprised of stretchable material and house an air-tight chamber inserted into either one or both of the cups, a pump or tube for inflating and deflating air in the chambers using an air valve and a press button. The chambers are located preferably at the top of either of the cups of the bra. The brassiere of the present invention uses the air chamber(s) to protect the chest area of a woman from impact and is used for enlarging and beautifying the breast of a woman. Additionally, the air chambers are provided with an air valve internally connected to a pump located under the arm pits as a means for inflating and deflating air.

It is an object of the present invention to provide an air bra that is filled air in air tight pockets by using a flapping action of arms of the wearer of the bra, which leads to pumping of air inside the chamber or pocket according to the desired amount by the wearer.

In is another object of the present invention to provide an air bra having pockets or air tight chambers made up of stretchable material such as spandex, nylon, cotton and/or a mixture thereof.

It is yet another object of the present invention to provide an air bra having a press button provided in the bra to press and release, to push the air valve and discharge the air in the airtight chamber thereby deflating the cups; thereby adjusting a size of said brassiere.

It is still yet another object of the present invention to provide an air bra that provides the advantage of protecting the chest area from frontal forceful impact from a ball during playing sports like rugby, football, and the like.

With the above and other objects in view which will appear as the description proceeds, the invention resides in combination and arrangement of parts and in the details of construction hereinafter described and claimed, it being understood that, within the scope of what is claimed, changes in the precise embodiment of the invention shown can be made without departing from the spirit of the invention.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which:

FIG. 1 illustrates a perspective view of a brassiere having air chambers and pump according to the present invention.

DETAILED DESCRIPTION OF THE INVENTION

Referring now to FIG. 1 there is shown and illustrated a brassiere 10 having airtight chambers 20 and a pump 30 in accordance with the present invention. By way opf example, but not of limitation, the brassiere shown and described will be a sports bra 12. In a preferred embodiment the airtight chambers 20 are embedded in two cups 14, 16, respectively, of the sports bra 12 wherein each of the air-collecting pockets or chambers 20 is provided with an air valve 22 being internally connected to a pump 30 located under the arm pits as a means of inflating and deflating air. Further, in the sports bra 12 the airtight pockets 20 are inflated with flapping action of arms of the wearer of the bra 12, which leads to pumping of air inside the chamber or pocket 20 according to the desired amount by the wearer. The pockets or air tight chambers 20 may be fabricated from stretchable material such as spandex, nylon, cotton and/or a mixture thereof. Lastly, chambers 20 are located preferably at the top of either of the cups of the bra 12. The press button provided in the bra is pressed and released to push the air valve and discharge the air in the air-tight chamber thereby deflating the cups; thereby, adjusting a size of said brassiere.

Turning once again to FIG. 1, the pump 30 is pre-mounted on an inner face of the bra 12 around or under the armpit, thereby facilitating the air filling by simple manual up and down motion of the wearer's hands, similar to the flapping of hands, thereby making the pump 30 hand-operated. The pump 30 includes a first one-way inlet valve which also acts as a second one-way outlet valve, an air inlet communicated with the air chambers 20, an air outlet communicated with the air chambers 20 and a normally closed air outlet valve 23. The pump 30 allows inflation of air into and deflation of air out of the air chambers 20 through manual operation.

In another preferred embodiment of the present disclosure, an airtight chamber 20 is embedded in two cups 14 and 16 thereof, each of said air-collecting pockets or chambers 20 are provided with an air valve 23 located under the arm pits being internally connected to a tube 22 as a means for inflating and deflating air. Further in the bra 12 the air tight pockets or chambers 20 are inflated with the tube 22 and air is filled manually by the wearer inside the chamber or pocket 20 according to the desired amount. The chamber 20 is located preferably at the top of either of the cups of the bra 12. The press button 32 provided in the bra is pressed and released to push the air valve 23 and discharge the air in the airtight chambers 20 thereby deflating the cups 14, 16 therewith; thereby adjusting a size of the brassiere 10.

In another preferred embodiment the chamber or pockets that are provided in the bra are located in the entire cups. Further the air chambers may also be placed in the entire front region of a shirt of a sportsman for full protection against the frontal impact from a ball during play. Further the chamber is designed to be made in an inner layer lying adjacent to the skin surface of the wearer and an outer layer lying further away from the skin surface with the inner layer being stiffer than the outer layer such that the chamber is capable of holding the air filled in without posing any pressure on the skin of the user. The material used for the chamber construction is of stretchable material to accommodate the amount of air filled inside the chamber without it tearing apart. In another preferred embodiment the brassiere there are other possible replacements to the valve used for controlling an amount of air in the air chamber. The normally closed valve is mounted in the bra, allowing inflation of air into the air chamber or release of air out of the air chamber. The valve includes a valve seat, a valve stem, a valve plug, and a spring.

It is contemplated within the scope of the disclosure described herein that any other type of bra may also be incorporated with the air filled chamber or pocket, including but not limited to sports bras or regular bras with the location of the chamber at the top of the cups and/or any other suitable location as per the requirement of the user.

In summary, the present invention is directed to a brassiere for breast enhancement and breast safety in women by providing a brassiere having two cups which are at least partially comprised of stretchable material, an airtight chamber inserted into either one or both of the cups, a means for inflating and deflating air; an air valve and a press button. The brassiere as disclosed in the present invention is embodied with air chambers for protecting the chest area from impact and is used for enlarging and beautifying the breast of women. The advantages of the brassiere is that it protects the chest area from frontal forceful impact froa a ball while playing sports like rugby, football, and the like. The air chamber technique as used herein can be successfully employed for men's shirts and the protection from impact for sportsman.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A brassiere for breast enhancement and breast safety for the chest area of a woman comprising:

a brassiere having two cups which are at least partially comprised of stretchable material, an airtight chamber inserted into either one or both of said cups, the airtight chamber being located at a top portion of the brassiere cup which is adjacent to a strap portion of the brassiere, a pump configured to force air into the airtight chamber when a wearer flaps their arms and an air valve having a press button for inflating and deflating the air in said airtight chamber; wherein said airtight chamber is configured to protect a chest area of a woman from impact and is used for enlarging and beautifying a breast of a woman.

2. The brassiere as claimed in claim 1 wherein said air valve is for controlling an amount of air in said airtight chamber.

3. The brassiere as claimed in claim 1 wherein said brassiere is a sports bra.

4. The brassiere as claimed in claim 1 wherein said air valve for inflating and deflating air is a tube.

5. The brassiere as claimed in claim 1 wherein said pump is configured to be located under the arm pits of the woman.

6. The brassiere as claimed in claim 1 wherein said press button is pressed to release ambient air to discharge air from said chambers thereby adjusting a size of said cups.

* * * * *